US006694776B1

(12) United States Patent
Parsnick et al.

(10) Patent No.: US 6,694,776 B1
(45) Date of Patent: Feb. 24, 2004

(54) CRYOGENIC AIR SEPARATION SYSTEM FOR PRODUCING OXYGEN

(75) Inventors: David R. Parsnick, Amherst, NY (US); Andrew E. Taraboletti, Williamsville, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/437,286

(22) Filed: May 14, 2003

(51) Int. Cl.[7] ..... F25J 3/00
(52) U.S. Cl. ..... 62/643
(58) Field of Search ..... 62/617, 640, 643, 62/648, 652

(56) References Cited

U.S. PATENT DOCUMENTS 4,806,136 A * 2/1989 Kiersz et al. ..... 62/18
5,235,816 A 8/1993 Parsnick et al. ..... 62/22
5,806,342 A 9/1998 Bonaquist et al. ..... 62/646
5,829,271 A 11/1998 Lynch et al. ..... 62/646
5,916,262 A 6/1999 Prosser et al. ..... 62/646
5,979,183 A * 11/1999 Smith et al. ..... 62/650
6,073,462 A 6/2000 Wong et al. ..... 62/654
6,253,577 B1 7/2001 Arman et al. ..... 62/646
6,256,994 B1 * 7/2001 Dillon, IV ..... 60/649
6,263,659 B1 * 7/2001 Dillon, IV et al. ..... 60/39.02
6,279,344 B1 8/2001 Drnevich et al. ..... 62/646
6,345,493 B1 * 2/2002 Smith et al. ..... 60/39.02
6,357,258 B1 * 3/2002 Mahoney et al. ..... 62/643
6,460,373 B1 10/2002 Bergman, Jr. et al. ..... 62/652

* cited by examiner

*Primary Examiner*—Denise L. Esquivel
*Assistant Examiner*—Malik N. Drake
(74) *Attorney, Agent, or Firm*—Stanley Ktorides

(57) ABSTRACT

A cryogenic air separation system for producing oxygen wherein essentially all of the power produced by a gas turbine system is used to compress feed air for the cryogenic air separation, and wherein preferably a facilitating column is employed to enhance the production of oxygen from the double column system.

14 Claims, 2 Drawing Sheets

FIG. I

CRYOGENIC AIR SEPARATION SYSTEM FOR PRODUCING OXYGEN

TECHNICAL FIELD

This invention relates generally to cryogenic air separation and, more particularly, to cryogenic air separation for the production of oxygen.

BACKGROUND ART

Oxygen is produced commercially in large quantities by the cryogenic rectification of feed air. The capital cost of cryogenic air separation plants to produce product oxygen in large volumes is quite high and any arrangement which serves to reduce these costs would be highly desirable.

One way to reduce the cost of high volume oxygen plants is to operate the plants at elevated pressures which would reduce the size and thus the cost of major components of the plants such as the columns and the main condenser. Unfortunately the compression costs to achieve such elevated pressures generally negate the resulting savings in capital costs.

Accordingly, it is an object of this invention to provide a cryogenic air separation system for producing oxygen which can operate at elevated pressures and wherein compression costs do not overcome savings in capital costs which may be achieved by the operation at elevated pressure.

SUMMARY OF THE INVENTION

The above and other objects, which will become apparent to those skilled in the art upon a reading of this disclosure, are attained by the present invention, one aspect of which is:

A method for producing oxygen by the cryogenic separation of feed air comprising:

(A) compressing feed air and passing the compressed feed air into a cryogenic air separation plant comprising a higher pressure column and a lower pressure column;

(B) combusting air and fuel to produce hot gas, expanding the hot gas in a gas turbine to produce power, and using essentially all of the power produced by the gas turbine to carry out the compression of the feed air; and (C) producing oxygen by cryogenic rectification within the cryogenic air separation plant, and recovering oxygen withdrawn from the cryogenic air separation plant as product.

Another aspect of the invention is:

Apparatus for producing oxygen by the cryogenic separation of feed air comprising:

(A) a cryogenic air separation plant comprising a higher pressure column and a lower pressure column, and a compression system comprising at least one compressor for compressing feed air for passage into the cryogenic air separation plant;

(B) a gas turbine for producing power by the expansion of hot gas and configured such that essentially all of the power produced by the gas turbine is used to operate the compression system; and (C) means for recovering product oxygen taken from the lower portion of the lower pressure column of the cryogenic air separation plant.

As used herein the term "column" means a distillation or fractionation column or zone, i.e. a contacting column or zone, wherein liquid and vapor phases are counter currently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

The term "double column" is used to mean a higher pressure column having its upper portion in heat exchange relation with the lower portion of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Distillation is the separation process whereby heating of a liquid mixture can be used to concentrate the more volatile component(s) in the vapor phase and thereby the less volatile component(s) in the liquid phase. Partial condensation is the separation process whereby cooling of a vapor mixture can be used to concentrate the more volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases can be adiabatic or nonadiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein the term "indirect heat exchange" means the bringing of two fluids into heat exchange relation without any physical contact or intermixing of the fluids with each other.

As used herein the term "product oxygen" means a fluid having an oxygen concentration of at least 95 mole percent.

As used herein the term "feed air" means a mixture comprising primarily oxygen and nitrogen, such as ambient air.

As used herein the terms "upper portion" and "lower portion" mean those sections of a column respectively above and below the mid point of the column.

As used herein the term "direct heat exchange" means the transfer of heat through contact of cooling and heating entities.

As used herein the term "gas turbine" means a system comprising a compressor, combustor and expander which produces power.

As used herein the term "facilitating column" means a system comprising a column and a top condenser which processes a feed comprising oxygen and produces a liquid having an oxygen concentration which exceeds that of the feed.

DETAILED DESCRIPTION

In general the invention employs a defined gas turbine system and preferably a facilitating column to drive the feed air compression system and to enable the cryogenic air separation plant to operate at elevated pressures for the production of product oxygen.

Figure 1:
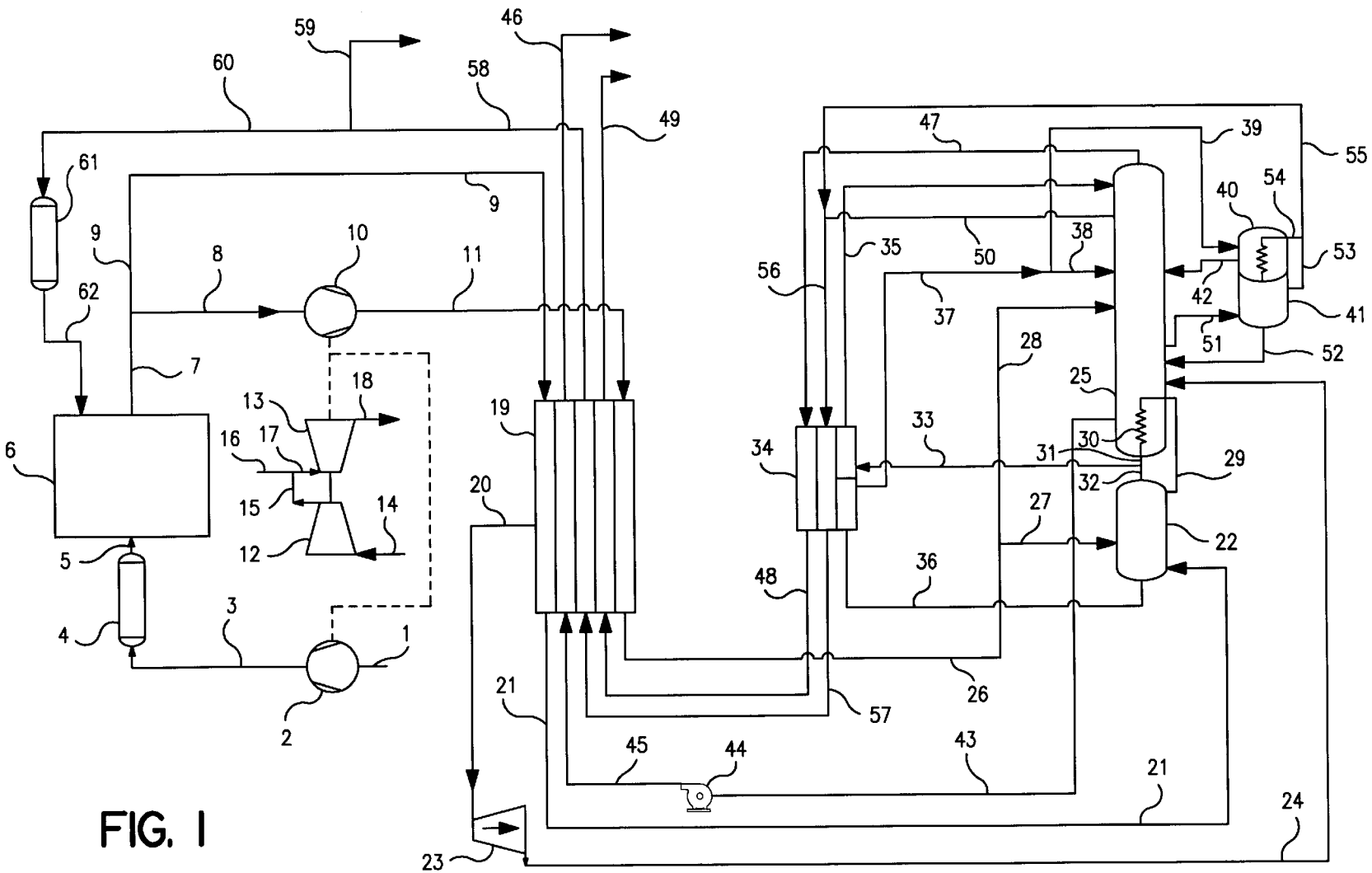
FIG. 1 is a schematic representation of one preferred embodiment of the cryogenic air separation system of this invention.

The invention will be described in detail with reference to the Drawings. Referring now to FIG. 1, feed air 1 is compressed to a pressure generally within the range of from 90 to 300 pounds per square inch absolute (psia), preferably at least 220 psia, by passage through main air compressor 2. The resulting compressed feed air stream 3 is cooled of the heat of compression by passage through two stage air cooling unit 4 by indirect heat exchange with an available heat sink such as ambient air, cooling water or glycol, and is further cooled by using refrigeration to a temperature typically within the range of from 6° C. to 18° C. The chilled feed air stream 5 is then passed to molecular sieve adsorbent dryer or prepurifier 6 wherein it is cleaned of high boiling impurities such as water vapor, carbon dioxide and hydrocarbons. In the preferred embodiment illustrated in FIG. 1, the cleaned feed air 7 is divided into booster feed air portion 8 and remaining feed air portion 9. Booster feed air portion 8, which typically comprises from about 25 to 30 percent of feed air stream 7, is further compressed to a pressure generally within the range of from 300 to 1200 psia by passage through booster compressor 10 to form boosted or further compressed air portion 11.

Main air compressor 2 and booster compressor 10 are driven by power produced by a gas turbine system comprising a gas turbine compressor 12 and a gas turbine expander 13. Air 14 is fed to compressor 12 wherein it is compressed to a pressure generally within the range of from 150 to 500 psia. The compressed air 15 is combined with fuel 16, such as natural gas or any other suitable fluid fuel, and the fuel/air mixture is combusted in a combustor (not shown) to produce hot gas 17 which is passed into expander 13. The hot gas is expanded in expander 13 to produce power and is then exhausted from expander 13 in gas turbine exhaust stream 18. Essentially all of the power produced by the gas turbine (other than the power used to drive the compressor of the gas turbine) is used to drive the compressors, i.e. main air compressor 2 and booster compressor 10, which compress the feed air for passage to the main heat exchanger of the cryogenic air separation plant and then to the columns of the cryogenic air separation plant. This is shown by the representative dotted lines in the Drawings.

Compressed feed air stream 9 and boosted feed air stream 11 are passed into main heat exchanger 19 wherein they are cooled by indirect heat exchange with return streams as will be described in greater detail below. A portion 20 of feed air stream 9 is withdrawn after partial traverse of main heat exchanger 19. The remaining portion 21 is passed into higher pressure column 22 which is operating at a pressure generally within the range of from 80 to 280 psia, preferably at least 190 psia. Portion 20 is turboexpanded by passage through turboexpander 23 to generate refrigeration, and the resulting turboexpanded feed air 24 is passed into lower pressure column 25 which is operating at a pressure less than that of higher pressure column 22 and generally within the range of from 20 to 80 psia, preferably at least 50 psia. Boosted feed air stream 11 is condensed by passage through main heat exchanger 19. Resulting liquid feed air 26 is passed in stream 27 into higher pressure column 22 and in stream 28 into lower pressure column 25.

Within higher pressure column 22 the feed air is separated by cryogenic rectification into oxygen-enriched liquid and nitrogen-enriched vapor. Nitrogen-enriched vapor is passed in stream 29 from the upper portion of higher pressure column 22 into main condenser 30 wherein it is condensed by indirect heat exchange with lower pressure column bottom liquid. Resulting nitrogen-enriched liquid 31 is passed in stream 32 as reflux into higher pressure column 22, and in stream 33 into subcooling heat exchanger 34 wherein it is subcooled by indirect heat exchange with return streams. Resulting subcooled nitrogen-enriched liquid stream 35 is passed from heat exchanger 34 into the upper portion of lower pressure column 25 as reflux.

Oxygen-enriched liquid is withdrawn from the lower portion of higher pressure column 22 in stream 36 and passed to heat exchanger 34 wherein it is subcooled by indirect heat exchange with return streams. Resulting subcooled oxygen-enriched liquid 37 is passed in stream 38 into lower pressure column 25. A portion 39 of subcooled oxygen-enriched liquid 37 is passed into top condenser 40 of facilitating column 41 wherein it is used to condense top vapor from the facilitating column. Resulting oxygen-enriched fluid, which may be in gaseous, liquid or dual phase form, is passed in stream 42 from top condenser 40 into lower pressure column 25.

Within lower pressure column 25 the various feeds into that column are separated by cryogenic rectification into oxygen-rich fluid and nitrogen-rich fluid. In the embodiment of the invention illustrated in FIG. 1, oxygen-rich fluid is withdrawn from the lower portion of lower pressure column 25 as liquid in stream 43 and pumped to a higher pressure by passage through liquid pump 44. If desired, a portion of oxygen-rich liquid stream 43 may be recovered as product oxygen. Resulting elevated pressure oxygen-rich liquid 45 is passed to main heat exchanger 19 wherein it is vaporized by indirect heat exchange with incoming feed air streams. Resulting vaporized oxygen-rich fluid is withdrawn from main heat exchanger 19 in stream 46 and recovered as product oxygen.

Nitrogen-rich fluid is withdrawn from the top of lower pressure column 25 in vapor stream 47 and warmed by passage through subcooling heat exchanger 34. It is then passed in stream 48 to main heat exchanger 19 wherein it is further warmed by indirect heat exchange with incoming feed air. Resulting warmed gaseous nitrogen is removed from the system in stream 49 which may be recovered, in whole or in part, as nitrogen product having a nitrogen concentration exceeding 99 mole percent and having an oxygen impurity of less than 500 parts per million by volume (ppmv).

For product purity control purposes a waste stream 50 is withdrawn from the lower pressure column at a level below the withdrawal point of stream 47, passed through heat exchangers 34 and 19, and then removed from the system. The embodiment of the invention illustrated in FIG. 1 is a preferred embodiment wherein waste stream 50 is combined with facilitating column vapor for processing.

In the preferred practice of this invention a facilitating column is used to enhance the operation of the double column system for the production of gaseous oxygen product. A vapor stream 51 is passed from the lower pressure column 25 of the double column system into facilitating column 41 wherein it undergoes cryogenic rectification to produce bottom liquid and vapor. Typically the facilitating column will have from 20 to 60 equilibrium stages and generally not more than 40 equilibrium stages. Liquid from the bottom of facilitating column 41 is passed into lower pressure column 25 in stream 52. Vapor, which generally has an argon concentration within the range of from 80 to 90 mole percent, is removed from column 41 in stream 53. A portion 54 of stream 53 is passed into top condenser 40 wherein it is condensed by indirect heat exchange with subcooled oxygen-enriched liquid 39. The resulting condensed facilitating column fluid is passed back into the facilitating column as liquid.

The remainder 55 of the facilitating column vapor is passed through heat exchangers 34 and 19 and preferably is used for further processing in upstream portions of the system. In the embodiment of the invention illustrated in FIG. 1, facilitating column vapor in stream 55 is combined with waste stream 50, which generally has a nitrogen concentration exceeding 95 mole percent and having an oxygen concentration of less than 2 mole percent, preferably less than 1 mole percent, to form combined stream 56. Stream 56 is warmed by passage through subcooling heat exchanger 34 and resulting stream 51 is further warmed by passage through main heat exchanger 19 by indirect heat exchange with incoming feed air wherein it serves to assist in providing cooling for the condensation of the boosted air portion. Resulting further warmed stream 58 may be removed from the system as shown by vent stream 59. Preferably at least some of stream 58, as illustrated in FIG. 1, is passed in stream 60 to reactivation heater 61 wherein it is heated, and then passed in stream 62 to prepurifier 6 wherein it is used to regenerate, i.e. to purge or clean, the molecular sieve adsorbent which is used in the prepurifier, before being passed out of the system.

The facilitating column operates at an elevated pressure generally within the range of from 20 to 80 psia and preferably at least 50 psia. The facilitating column receives oxygen rich vapor as feed from the lower pressure column and concentrates essentially all of the oxygen in a liquid for return to the lower pressure column. All of the nitrogen and most of the argon in the feed to the facilitating column is rejected in the facilitating column overhead vapor stream. This increases the recovery of oxygen product from the lower pressure column. Without the use of the facilitating column there would be required a significant increase in the number of stages in the lower pressure column to obtain comparable recoveries. This would make the lower pressure column prohibitively large and expensive. The use of the facilitating column enables the economical attainment of high oxygen recoveries because its vapor rate is only about one-third that in the lower pressure column.

Figure 2:
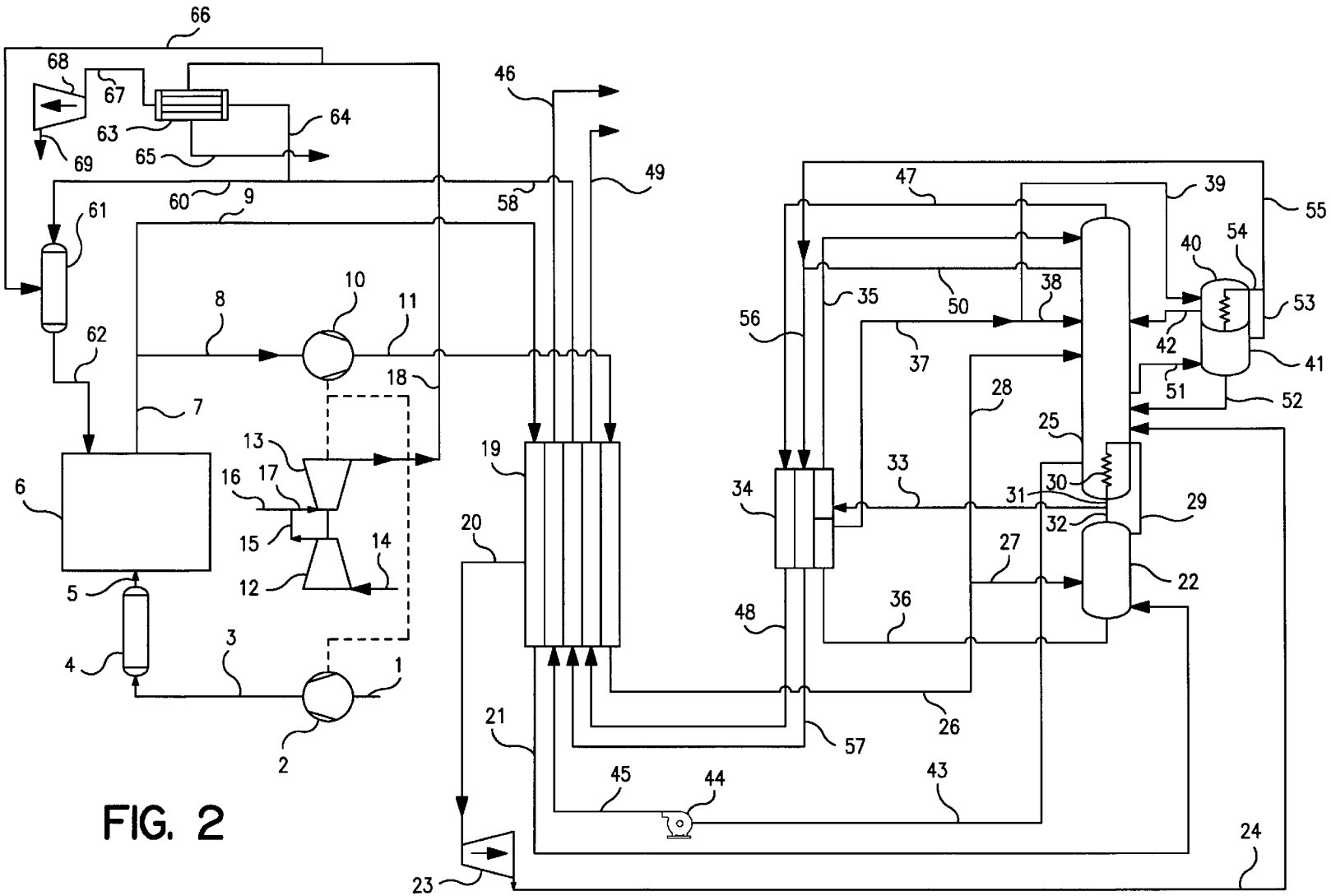
FIG. 2 is a schematic representation of another preferred embodiment of the cryogenic air separation system of this invention.

FIG. 2 illustrates another preferred embodiment of the invention wherein heat from the gas turbine exhaust gas is gainfully employed in combination with the processing of facilitating column vapor. The numerals of FIG. 2 are the same as those of FIG. 1 for the common elements, and the common elements will not be discussed again in detail.

Referring now to FIG. 2, gas turbine exhaust gas 18 is passed to waste heater 63 wherein it is used to heat a portion 64 of stream 58 and from which it is removed in stream 65. A portion 66 of stream 18 is passed to heater 61 wherein it is employed to provide heat to stream 60 which is then passed in stream 62 to prepurifier 6. Stream 64, after it is heated in waste heater 63, is passed in stream 67 to expander 68 wherein it is expanded to generate power, which may be used within the system, and from which it is exhausted in stream 69. If desired, vapor from the facilitating column, after it is heated by the gas turbine exhaust gas, may be used to provide heat to the reactivation heater.

Although the invention has been described in detail with reference to certain particularly preferred embodiments, those skilled in the art will recognize that there are other embodiments of the invention within the spirit and the scope of the claims. For example the gas turbine exhaust may be used to drive an absorption chiller which produces refrigeration which may be used in the cryogenic air separation system.

What is claimed is:

1. A method for producing oxygen by the cryogenic separation of feed air comprising:

(A) compressing feed air and passing the compressed feed air into a cryogenic air separation plant comprising a higher pressure column and a lower pressure column;

(B) combusting air and fuel to produce hot gas, expanding the hot gas in a gas turbine to produce power, and using essentially all of the power produced by the gas turbine to carry out the compression of the feed air; and (C) producing oxygen by cryogenic rectification within the cryogenic air separation plant, and recovering oxygen withdrawn from the cryogenic air separation plant as product, wherein the feed air is compressed in a main air compressor, a portion of the compressed feed air from the main compressor is further compressed in a booster compressor, and the further compressed feed air from the booster compressor is condensed prior to being passed into the cryogenic air separation plant.

2. The method of claim 1 wherein the condensed feed air is passed into both the higher pressure column and the lower pressure column of the cryogenic air separation plant.

3. The method of claim 1 wherein the cryogenic air separation plant further comprises a facilitating column which processes fluid taken from the lower pressure column and which produces facilitating column vapor which is heated by indirect heat exchange with the further compressed feed air to effect at least in part the condensation of the further compressed feed air.

4. Apparatus for producing oxygen by the cryogenic separation of feed air comprising:

(A) a cryogenic air separation plant comprising a higher pressure column and a lower pressure column, and a compression system comprising at least one compressor for compressing feed air for passage into the cryogenic air separation plant;

(B) a gas turbine for producing power by the expansion of hot gas and configured such that essentially all of the power produced by the gas turbine is used to operate the compression system; and (C) means for recovering product oxygen taken from the lower portion of the lower pressure column of the cryogenic air separation plant, further comprising a facilitating column and means for passing fluid from the lower pressure column to the facilitating column.

5. The apparatus of claim 4 wherein the compression system comprises a main air compressor and a booster compressor.

6. The apparatus of claim 4 further comprising a prepurifier and means for passing vapor from the facilitating column to the prepurifier.

7. The apparatus of claim 4 further comprising a waste expander and a waste heater, and means for passing vapor from the facilitating column to the waste heater and from the waste heater to the waste expander.

8. The apparatus of claim 7 further comprising means for passing gas from the gas turbine to the waste heater.

9. A method for producing oxygen by the cryogenic separation of feed air comprising:

(A) compressing feed air and passing the compressed feed air into a cryogenic air separation plant comprising a higher pressure column and a lower pressure column;

(B) combusting air and fuel to produce hot gas, expanding the hot gas in a gas turbine to produce power, and using essentially all of the power produced by the gas turbine to carry out the compression of the feed air; and (C) producing oxygen by cryogenic rectification within the cryogenic air separation plant, and recovering oxygen withdrawn from the cryogenic air separation plant as product, wherein the cryogenic air separation plant further comprises a facilitating column which processes fluid taken from the lower pressure column and which produces facilitating column vapor.

10. The method of claim 9 wherein the facilitating column is operating at an elevated pressure within the range of from 20 to 80 psia.

11. The method of claim 9 wherein facilitating column vapor is heated and then turboexpanded to produce power.

12. The method of claim 11 wherein the facilitating column vapor is heated by heat exchange with hot gas taken from the gas turbine.

13. The method of claim 9 wherein the feed air is processed in a prepurifier and wherein facilitating column vapor is used to regenerate the prepurifier.

14. The method of claim 9 wherein the feed air is processed in a prepurifier, wherein facilitating column vapor is heated by heat exchange with hot gas taken from the gas turbine, and wherein the heated facilitating column vapor is used to regenerate the prepurifier.

* * * * *